US011598041B2

(12) United States Patent
Gao et al.

(10) Patent No.: US 11,598,041 B2
(45) Date of Patent: Mar. 7, 2023

(54) MICROBUBBLE GENERATOR AND LAUNDRY TREATING DEVICE

(71) Applicant: WUXI LITTLE SWAN ELECTRIC CO., LTD., Wuxi (CN)

(72) Inventors: Yuan Gao, Wuxi (CN); Yongjian Deng, Wuxi (CN); Ming Xiong, Wuxi (CN); Jin Sun, Wuxi (CN)

( * ) Notice: Subject to any disclaimer, the term of this patent is extended or adjusted under 35 U.S.C. 154(b) by 101 days.

(21) Appl. No.: 16/971,306

(22) PCT Filed: Dec. 14, 2018

(86) PCT No.: PCT/CN2018/121188

§ 371 (c)(1),
(2) Date: Aug. 20, 2020

(87) PCT Pub. No.: WO2020/093523

PCT Pub. Date: May 14, 2020

(65) Prior Publication Data

US 2021/0010179 A1 Jan. 14, 2021

(30) Foreign Application Priority Data

Nov. 5, 2018 (CN) ..... 201811308847.0
Nov. 5, 2018 (CN) ..... 201821815986.8

(51) Int. Cl.
*D06F 35/00* (2006.01)
*D06F 39/08* (2006.01)
(Continued)

(52) U.S. Cl.
CPC ..... *D06F 35/002* (2013.01); *B01F 23/238* (2022.01); *B01F 23/23121* (2022.01);
(Continued)

(58) Field of Classification Search
CPC ..... D06F 35/002; D06F 17/06; D06F 39/088; B01F 25/3121; B01F 25/4231; B01F 31/81; B01F 2101/305
See application file for complete search history.

(56) References Cited

U.S. PATENT DOCUMENTS

2003/0047622 A1 3/2003 Ivannikov et al.
2010/0263410 A1 10/2010 Oak et al.
(Continued)

FOREIGN PATENT DOCUMENTS

CN 102069045 A 5/2011
CN 104591313 A 5/2015
(Continued)

OTHER PUBLICATIONS

OA for CN application 201811308335.4.
(Continued)

*Primary Examiner* — Joseph L. Perrin
(74) *Attorney, Agent, or Firm* — Kilpatrick Townsend & Stockton, LLP

(57) ABSTRACT

A microbubble generator and a laundry treating device. The microbubble generator includes: an air dissolving tank, having an air dissolving cavity defined therein, and an inlet and an outlet configured to allow water to flow in and out, the inlet being located above the outlet; a baffle, provided in the air dissolving tank, at least partially located between the inlet and the outlet in a horizontal direction, and provided with a gap and/or a through hole; and a cavitator, provided outside the air dissolving tank and connected with the outlet, or provided at the outlet.

10 Claims, 2 Drawing Sheets

(51) Int. Cl.

| | |
|---|---|
| ***B01F 23/23*** | (2022.01) |
| ***B01F 23/231*** | (2022.01) |
| ***B01F 25/312*** | (2022.01) |
| ***B01F 25/421*** | (2022.01) |
| ***B01F 31/81*** | (2022.01) |
| ***D06F 17/06*** | (2006.01) |
| ***B01F 101/00*** | (2022.01) |

(52) U.S. Cl.
CPC ..... *B01F 25/3121* (2022.01); *B01F 25/4231* (2022.01); *B01F 31/81* (2022.01); *D06F 17/06* (2013.01); *D06F 39/088* (2013.01); *B01F 2101/305* (2022.01)

(56) References Cited

U.S. PATENT DOCUMENTS

| | | | | |
|---|---|---|---|---|
| 2012/0204607 | A1 | 8/2012 | Yang et al. | |
| 2015/0352505 | A1 | 12/2015 | Yokota et al. | |
| 2018/0087203 | A1 | 3/2018 | Hwang | |
| 2018/0087211 | A1* | 3/2018 | Hwang | D06F 33/34 |
| 2018/0134593 | A1* | 5/2018 | Remer | B01F 23/232311 |
| 2018/0274149 | A1* | 9/2018 | Kim | D06F 35/002 |
| 2018/0274150 | A1* | 9/2018 | Hwang | D06F 17/12 |
| 2018/0274151 | A1* | 9/2018 | Hwang | D06F 35/002 |
| 2018/0274152 | A1* | 9/2018 | Hwang | B01F 25/4337 |
| 2018/0274153 | A1* | 9/2018 | Hwang | B01F 23/23412 |
| 2018/0274163 | A1* | 9/2018 | Hwang | D06F 39/083 |
| 2018/0274164 | A1* | 9/2018 | Kim | B01F 23/2323 |
| 2018/0298541 | A1* | 10/2018 | Sasaki | D06F 58/24 |
| 2019/0301069 | A1* | 10/2019 | Hwang | B01F 25/4334 |
| 2019/0301070 | A1* | 10/2019 | Hwang | D06F 23/04 |
| 2019/0301075 | A1* | 10/2019 | Hwang | D06F 35/002 |
| 2020/0246763 | A1* | 8/2020 | Uchiyama | B01F 25/441 |

FOREIGN PATENT DOCUMENTS

| | | | |
|---|---|---|---|
| CN | 104927901 | A | 9/2015 |
| CN | 105986400 | A | 10/2016 |
| CN | 107869023 | A | 4/2018 |
| CN | 207362525 | U | 5/2018 |
| EP | 1754529 | A1 | 2/2007 |
| EP | 2925923 | B1 | 1/2017 |
| EP | 3396044 | A1 | 10/2018 |
| JP | S61291100 | A | 12/1986 |
| JP | H07328402 | A | 12/1995 |
| JP | H08103641 | A | 4/1996 |
| JP | 2003225546 | A | 8/2003 |
| JP | 2005329100 | A | 12/2005 |
| JP | 2008161734 | A | 7/2008 |
| JP | 2008290015 | A | 12/2008 |
| JP | 2009082903 | A | 4/2009 |
| JP | 2010029770 | A | 2/2010 |
| JP | 2010115594 | A | 5/2010 |
| JP | 2010227780 | A | 10/2010 |
| JP | 2011020096 | A | 2/2011 |
| JP | 2013111505 | A | 6/2013 |
| JP | 2013184138 | A | 9/2013 |
| JP | 2014104441 | A | 6/2014 |
| JP | 2014226598 | A | 12/2014 |
| JP | 2015077600 | A | 4/2015 |
| JP | 2016055261 | A | 4/2016 |
| JP | 2016203109 | A | 12/2016 |
| JP | 2017527439 | A | 9/2017 |
| JP | 2018086628 | A | 6/2018 |
| JP | 3217792 | U | 8/2018 |
| KR | 20130009318 | A | 1/2013 |
| KR | 101568209 | B1 | 11/2015 |
| RU | 2553900 | C2 | 6/2015 |
| SU | 1148957 | A1 | 4/1985 |
| WO | 0130229 | A1 | 5/2001 |
| WO | 2005115596 | A1 | 12/2005 |
| WO | 2010055701 | A1 | 5/2010 |

OTHER PUBLICATIONS

OA for JP application 2021-502589.
OA for RU application 2020142877.
OA for JP application 2020-537728.
OA for RU application 2020142899.
Search Report for EP application 18939574.2.
Search Report for EP application 18939384.6.
International Search Report of PCT/CN2018/121188.
OA for IN application 202027051828.
OA for IN application202027051831.
OA dated Jul. 5, 2022 for JP application 2021-502589.

* cited by examiner

MICROBUBBLE GENERATOR AND LAUNDRY TREATING DEVICE

CROSS-REFERENCES TO RELATED APPLICATIONS

The present disclosure is a national phase application of International Application No. PCT/CN2018/121188, filed on Dec. 14, 2018, which claims priority to Chinese Patent Applications Serial No. 201811308847.0, filed on Nov. 5, 2018, and No. 201821815986.8, filed on Nov. 5, 2018, the entire contents of which are incorporated herein by reference.

FIELD

The present application relates to the field of laundry treatment, and more particularly to a microbubble generator and a laundry treating device.

BACKGROUND

At present, a microbubble technology is mainly applied in the field of environmental protection, and also in households, such as skin care, showers, and a laundry treating device. Most of the current microbubble generators have complex structures, some are required to be provided with additional water pumps, and some are required to be controlled by valves. Meanwhile, there are more restrictions on the way of feeding water, resulting in relatively high costs.

SUMMARY

The present disclosure seeks to solve at least one of the problems existing in the related art to at least some extent. To this end, the present application proposes a microbubble generator with a good bubble generating effect and a simple structure.

The present disclosure further seeks to provide a laundry treating device having the microbubble generator.

The microbubble generator according to an embodiment of the present application includes: an air dissolving tank, having an air dissolving cavity defined therein, the air dissolving cavity having an inlet and an outlet configured to allow water to flow in and out, the inlet located above the outlet; a baffle, provided in the air dissolving tank, at least partially located between the inlet and the outlet in a horizontal direction, and provided with a gap and/or a through hole; a cavitator, provided outside the air dissolving tank and connected with the outlet, or provided at the outlet.

In the microbubble generator according to the present disclosure, with an ingenious structure, using a flow velocity difference between outflow water and inflow water of the air dissolving cavity and a height difference between the inlet and the outlet, a water seal is formed at the outlet, and the pressure in the air dissolving cavity gradually rises to form a high-pressure cavity, increasing the air dissolving amount. The microbubble generator according to the present disclosure has a simple structure, good air dissolving effects and low costs.

In some embodiments, a distance between the inlet and at least one side wall of the air dissolving cavity is less than 50 mm.

In one embodiment, a distance between the inlet and at least one side wall of the air dissolving cavity ranges from 1 mm to 20 mm.

Further, the air dissolving cavity has a square section in the horizontal direction, and the inlet and the outlet are provided corresponding to two ends of the square having the longest straight-line distance between the two ends.

In one embodiment, the air dissolving tank is provided with two air dissolving semi-casings fastened with each other, the inlet is provided in one of the air dissolving semi-casings and the outlet is provided in the other one of the air dissolving semi-casings.

In some embodiments, the two air dissolving semi-casings are in contact fit with each other at a joint by means of a step surface.

In some embodiments, an outer surface of the air dissolving tank is provided with reinforcing ribs arranged horizontally and vertically in a staggered manner.

In some embodiments, an upper portion of the air dissolving tank is provided with a water inlet pipe in communication with the top of the air dissolving cavity, a lower portion of the air dissolving tank is provided with a water outlet pipe in communication with the bottom of the air dissolving cavity, and the water inlet pipe and the water outlet pipe are disposed horizontally.

In some embodiments, the microbubble generator is configured and a flow velocity of outflow water is less than a flow velocity of inflow water when the air is dissolved.

In some embodiments, the cavitator includes: a cavitation casing, provided therein with a water cavity having a cavitation inlet and a cavitation outlet for water to flow in and out, the cavitation inlet being connected with the outlet of the air dissolving tank; a cavitation ball, movably disposed in the water cavity. The water flowing in from the cavitation inlet can push the cavitation ball to block the cavitation outlet, and when the cavitation ball is blocked at the cavitation outlet, a Venturi channel is formed between the cavitation ball and an inner wall of the water cavity.

A laundry treating device according to an embodiment of the present disclosure is provided with the microbubble generator according to the above-mentioned embodiment of the present disclosure at a water inlet of the laundry treating device.

In the laundry treating device according to the embodiment of the present disclosure, with the above-mentioned microbubble generator, the cost is low and the microbubble generating effect is good. A large number of microbubbles in washing water reduces the usage amount of washing powder or detergent, saves water and electricity resources, and reduces the residual washing powder or detergent on the laundry.

Embodiments of the present application will be given in part in the following descriptions, become apparent in part from the following descriptions, or be learned from the practice of the embodiments of the present disclosure.

BRIEF DESCRIPTION OF THE DRAWINGS

Embodiments of the present disclosure will become apparent and more readily appreciated from the following descriptions of the embodiments made with reference to the drawings, in which.

Figure 1:
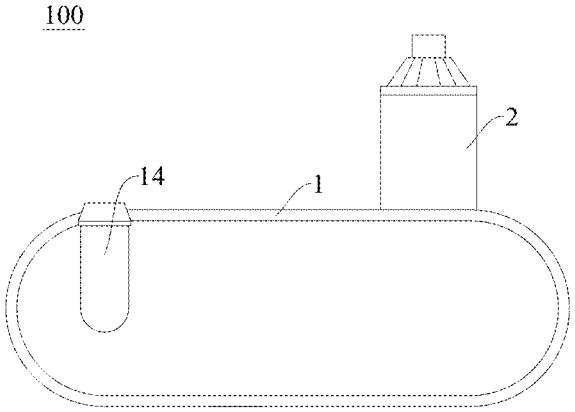
FIG. 1 is a schematic structural diagram of a microbubble generator according to an embodiment of the present application.

REFERENCE NUMERALS microbubble generator 100, air dissolving tank 1, air dissolving cavity 10, inlet 11, outlet 12, air dissolving semi-casing 13, water inlet pipe 14, step surface 16, reinforcing rib 17, cavitator 2, water cavity 20, cavitation inlet 21, cavitation outlet 22, cavitation casing 23, cavitation ball 24, Venturi channel 25, Venturi tube 28, orifice plate 29, baffle 3, gap 31.

DETAILED DESCRIPTION OF THE DISCLOSURE

Reference will be made in detail to embodiments of the present application. The examples of the embodiments are illustrated in the drawings. The same or similar elements and the elements having same or similar functions are denoted by like reference numerals throughout the descriptions. The embodiments described herein with reference to drawings are illustrative, and used to generally understand the present disclosure. The embodiments shall not be construed to limit the present application.

The microbubble generator 100 according to an embodiment of the present application will be described with reference to FIGS. 1 to 6.

Figure 2:
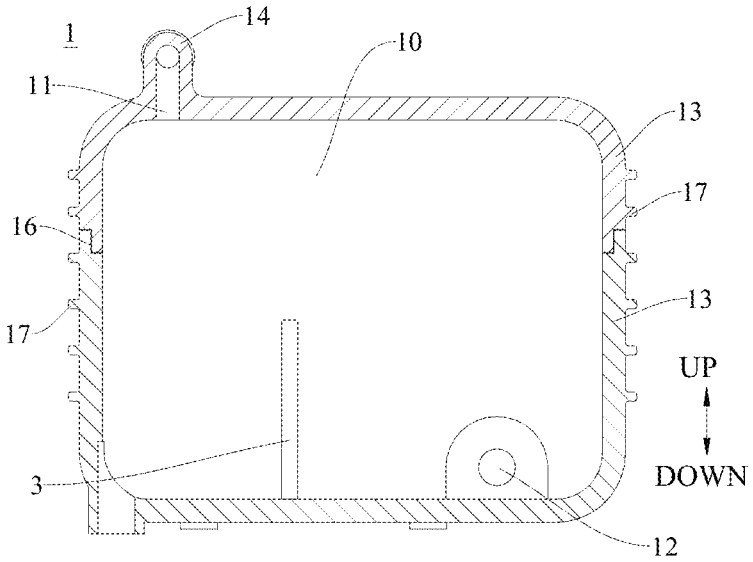
FIG. 2 is a schematic sectional view of an air dissolving tank according to an embodiment of the present application.

As shown in FIGS. 1 and 2, the microbubble generator 100 according to an embodiment of the present application includes: an air dissolving tank 1 and a cavitator 2. The air dissolving tank 1 has an air dissolving cavity 10 defined therein, and the air dissolving cavity 10 has an inlet 11 and an outlet 12 configured to feed and discharge water. The cavitator is provided outside the air dissolving tank 1 and connected with the outlet 12, or provided at the outlet 12. The cavitator 2 produces microbubbles from the gas dissolved in water using a cavitation effect.

When the microbubble generator 100 is used, water soluble gas enters from air dissolving tank 1, and afterwards, the water containing air solute with a high concentration enters the cavitator 2. The cavitator 2 produces the microbubbles using the cavitation effect. The water flow discharged from the cavitator 2 contains a large number of microbubbles for various uses, such as washing.

In the embodiment of the present disclosure, the inlet 11 of the air dissolving tank 1 is located above the outlet 12. Moreover, the microbubble generator 100 is configured and a flow velocity of outflow water is less than a flow velocity of inflow water when the air is dissolved, i.e., the outflow water is less than the inflow water per unit time. The air dissolving cavity 10 finishes air dissolution by forming a water seal at the outlet 12.

In one embodiment, the water flow is injected to the air dissolving tank 1 from the inlet 11. Since the flow velocity of inflow water is greater than the flow velocity of outflow water, the water level in the air dissolving cavity 10 rises gradually after water is injected in the air dissolving tank 1 for a period of time. Due to the inlet 11 of the air dissolving tank 1 located above the outlet 12, the water level of the air dissolving cavity 10 would be over the outlet 12 when rising, and a water seal is formed at the outlet 12, forming a high-pressure cavity with the pressure in the air dissolving cavity 10 rising gradually.

It should be emphasized here that although the water seal is formed at the outlet 12, water is still discharged from the outlet 12 to the cavitator 2, but water is continuously introduced into the inlet 11. Therefore, the water level in the air dissolving cavity 10 is still rising continuously, which gradually reduces the air space above the water surface. When the air pressure in the air dissolving tank 1 gradually rises to the water pressure near the inlet water, the flow velocity of outflow water is equal to the flow velocity of inflow water.

Therefore, the pressure in an upper part of the air dissolving cavity 10 is raised gradually to form a high-pressure cavity, and a dissolvability of the air in the high-pressure state is greater than a dissolvability thereof in the low-pressure state, thus the dissolvability of air inside the air dissolving cavity 10 in water is increased greatly. A large amount of air is dissolved in the water flowing to the cavitator 2, and the cavitator 2 may produce a large number of microbubbles.

It should be noted that air is insoluble with respect to water. A percentage of the amount of air dissolved in water and the introduced amount of air is called as an air dissolving efficiency. The air dissolving efficiency is related to temperature, an air dissolving pressure, and a dynamic contact area of air and liquid phases. The method of changing the water temperature or air temperature is difficult to implement. The common method for improving the air dissolving efficiency is to use a booster pump to pressurize the air dissolving cavity 10, but various valves are required to be provided, so the cost of providing the booster pump is too high.

In the prior art, there is also a solution in which double inlets are provided in the air dissolving device, one inlet configured to introduce water, and the other inlet configured to introduce air. In one embodiment, in order to inject air into water, the booster pump is required to press the air into the water. In this solution, since the air inlet is located below the cavitator, the incoming bubbles will quickly flow toward the cavitator and be squeezed out. No space is available in the air dissolving tank for the bubbles to dissolve slowly, and the air dissolving effect is not ideal. The method of injecting air into the water by pressurizing is equivalent to directly pressing large bubbles into the water. Such large bubbles stay in water for a short period of time and are dissolved insufficiently. Even when passing through the cavitator, the large bubbles are squeezed into more small bubbles by the cavitator, but the small bubbles are millimeter-sized or greater, and will be quickly broken and released.

It should be emphasized that in the embodiment of the present disclosure, it is proposed that the air-dissolving tank 1 dissolves air in water, which means that air is taken as a solute and dissolved in water, i.e., air is dispersed in water molecules in the form of ions. Air ions are dispersed in a state that air is dissolved, and the air ions in water molecules are relatively uniform. Afterwards, most of the bubbles precipitated by the cavitation effect only have a size of nanometers and micrometers at the beginning of formation. This is the desired microbubble produced by the microbubble generator 100. After the water with microbubbles flows to a final place for use, the microbubbles are dissolved with each other, and most of the obtained microbubbles may still be kept to be millimeter-sized or even less, with the best effect. The air dissolved in the water usually precipitates incompletely in the cavitator 2. In use, the air dissolved in the water will slowly replenish the microbubbles.

Figure 3:
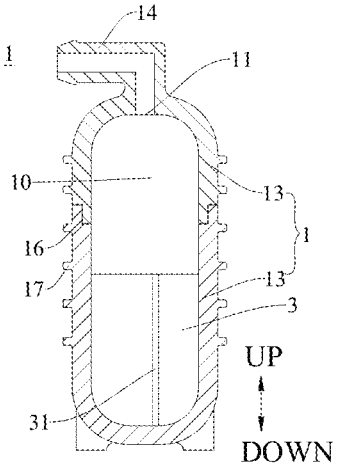
FIG. 3 is a another schematic sectional view of an air dissolving tank according to an embodiment of the present application.

In the embodiment of the present disclosure, as shown in FIGS. 2 and 3, in the horizontal direction, the baffle 3 is at least partially located between the inlet 11 and the outlet 12. the baffle 3 is provided with a gap 31 or a through hole, or both the gap 31 and the through hole. The baffle 3 is provided between the inlet 11 and the outlet 12, which intercepts the water flowing in from the inlet 11 towards the outlet 12. The gap 31 or through hole on the baffle 3 enables the water with air dissolved therein to flow through, but the bubbles caused by splash in the air dissolving cavity 10 are blocked. Large bubbles flow toward the cavitator 2, because the air in the air dissolving tank 1 would be wasted, resulting in the rapid decrease in air pressure of the air dissolving cavity 10 and influencing air dissolution. Moreover, after the large bubbles enter the cavitator 2, the cavitation effect would be affected.

Further, with the baffle 3, more splash may be formed when the water flow comes onto the baffle 3, and the baffle 3 may also be configured as a strengthening structure to enhance the pressure bearing ability of the air dissolving tank 1.

The feature mentioned herein that the baffle 3 is at least partially located between the inlet 11 and the outlet 12 in the horizontal direction means that the baffle 3 may be completely located between the inlet 11 and the outlet 12 as shown in FIG. 2, and the baffle 3 may also be merely partially located between the inlet 11 and the outlet 12. For example, the baffle 3 may be formed as an arc-shaped plate or a spherical plate, and the baffle 3 is covered at the outlet 12. At this point, the baffle 3 is merely partially located between the inlet 11 and the outlet 12.

In the embodiment of the present disclosure, since the inlet 11 is located above the outlet 12, when introduced from the inlet 11, the water rushes to the water surface from above, causing the water surface to oscillate, and at the same time a part of high-pressure air is brought in, and a dynamic contact area of air and water may be increased. Moreover, since the baffle is provided between the inlet 11 and the outlet 12, the flow path of the water flowing in the air dissolving cavity 10 is longer, which on the one hand, reduces the bubbles generated by the impact of the incoming water flow flowing from the outlet 12 due to being wrapped by the water flow, and on the other hand, increases the dissolution time and contact area of the excited bubbles in water. Herein, the large bubbles generated by waterflow blast are prevented from flowing toward the cavitator 2, because the amount of air in the air dissolving tank 1 would be wasted to affect the cavitation effect.

In the microbubble generator 100 according to the embodiment of the present disclosure, neither power nor valves is required, and the generation of microbubbles is implemented using a simple structure.

In the microbubble generator 100 according to the embodiment of the present disclosure, with an ingenious structure, using a flow velocity difference between outflow water and inflow water of the air dissolving cavity 10 and a height difference between the inlet 11 and the outlet 12, a water seal is formed at the outlet 12, and the pressure in the air dissolving cavity gradually rises to form a high-pressure cavity, increasing the air dissolving amount. The microbubble generator 100 has a simple structure, good air dissolving effects and low costs. The arrangement of the baffle 3 may reduce the amount of bubbles discharged from the air dissolving tank 1, enhance the air dissolving effect and strengthen the structure.

It should be additionally noted that the air dissolving tank 1 may be formed into any shape, and the shape of the air dissolving tank 1 is not specifically limited herein. However, other parts of the air dissolving tank 1 are required to have good airtightness except for the outlet 12 in the air dissolution.

In some embodiments, as shown in FIG. 3, the part of the air dissolving cavity 10 perpendicular to the inlet 11 has a small sectional area. It is understood that when water enters the air dissolving cavity 10, the incoming water flow would hit the inner wall and the water level of the air dissolving cavity 10. This phenomenon will produce more splash, and the generation of splash will help bring the water into the above high-pressure air, increasing the speed of air dissolving in the water. The part of the air dissolving cavity 10 perpendicular to the inlet 11 has the small sectional area, which contributes to the strong physical interaction between the splash generated when the water flow from the inlet 11 hit the water surface with the inner wall of the air dissolving cavity 10, and the water may dissolve air rapidly.

In some embodiments, as shown in FIG. 3, an inflow direction of the inlet 11 is downward vertically, and the incoming water flow enters the air dissolving cavity 10 in a vertical direction, which not only increases the splash, but also accelerates the air dissolving speed, and facilitates the manufacturability of mass production of the air dissolving tank 1. In other embodiments of the present application, the inflow direction of the inlet 11 may also be inclined, i.e., the inflow direction of water may have an included angle with the vertical direction, so the incoming water blast area is very large.

In some embodiments, in the horizontal direction, as shown in FIG. 2, the inlet 11 and the outlet 12 are located at two ends of the air dissolving tank 1, and the path of the water flow inside the air dissolving tank 1 is further lengthened and the bubbles generated by the water flow are further reduced to flow out of the outlet 12.

The air dissolving cavity 10 has a square section in the horizontal direction, and the inlet 11 and the outlet 12 are provided corresponding to two ends of the square having the longest straight-line distance between the two ends. For example, the air dissolving cavity 10 has a rectangular section in the horizontal direction, and the inlet 11 and the outlet 12 are located at two ends of a long side of the rectangle. Such an air dissolving tank 1 is easy to process and easy to lay out during assembly. In other embodiments of the present disclosure, the sectional shape of the air dissolving cavity 10 may be any shape and is not limited to the rectangle, rhombus, or other irregular square shapes.

In one embodiment, as shown in FIG. 2, the inlet 11 is located at the uppermost part of the air dissolving cavity 10, which may ensure that the incoming water flow arouses more splash and improve the air dissolving effect. In one embodiment, the outlet 12 is located at the very bottom of the air dissolving cavity 10, and the outlet 12 may form the water seal as soon as possible.

In some embodiments, a distance between the inlet 11 and at least one side wall of the air dissolving cavity 10 is less than 50 mm. That is, when the inlet 11 is in the working state, a distance between a projection to the water surface in the vertical direction and the inner wall surface of the at least one air dissolving cavity 10 is less than 50 mm. The water flow at the inlet 11 is more likely to hit the side wall of the air dissolving tank 1 to generate splash, improving the air dissolving effect of the air dissolving tank 1. In one embodiment, the distance between the inlet 11 and the at least one side wall of the air dissolving cavity 10 is between 1 mm and 20 mm. In other embodiments of the present disclosure, the inner wall of the air dissolving cavity 10 may be provided with a structure, such as an internal convex rib, which makes it easier to splash water.

In some embodiments, as shown in FIGS. 2 and 3, the air dissolving tank 1 is provided with two air dissolving semi-casings 13 fastened with each other. The inlet 11 is provided in one of the air dissolving semi-casings 13 and the outlet 12 is provided in the other one of the air dissolving semi-casings 13. The inlet 11 and the outlet 12 are arranged on the two air dissolving semi-casings 13 respectively, which is easy to form, and the strength of each of the air dissolving semi-casings 13 is not too low. Such the air dissolving tank 1 has strong manufacturability, is convenient for mass production, and has low processing costs.

In one embodiment, the two air dissolving semi-casings 13 are connected by welding or gluing, to ensure the airtightness.

In one embodiment, the air dissolving tank 1 is configured as a plastic part. In one embodiment, each of the air dissolving semi-casings 13 is an integrally injection-molded part.

Further, as shown in FIGS. 1 to 3, an upper portion of the air dissolving tank 1 is provided with a water inlet pipe 14 in communication with the top of the air dissolving cavity 10, a lower portion of the air dissolving tank 1 is provided with a water outlet pipe (not shown) in communication with the bottom of the air dissolving cavity 10, and the water inlet pipe 14 and the water outlet pipe are disposed horizontally, which facilitates assembly. For example, when the microbubble generator 100 is integrated with a detergent box, the air dissolving tank 1 is mounted behind the detergent box, and the water inlet pipe 14 and the water outlet pipe are horizontally arranged to make assembly easier.

In one embodiment, as shown in FIGS. 2 and 3, the two air dissolving semi-casings 13 are arranged up and down, the water inlet pipe 14 is integrally formed on the upper air dissolving semi-casing 13, and the water outlet pipe 15 is integrally formed on the lower air dissolving semi-casing 13, which may guarantee the convenience and sealing performance.

In one embodiment, the two air dissolving semi-casings 13 are in contact fit with each other at a joint by means of a step surface 16, which not only increases the contact area at the contact point of the two air dissolving semi-casings 13, but also increases the contact strength, and at least part of the contact surface of the two air dissolving semi-casings 13 is perpendicular or nearly perpendicular to the pressure of the inner wall of the air dissolving cavity 10. Therefore, the two air dissolving semi-casings 13 will be pressed more and more tightly at the joint due to the high internal pressure, to avoid cracking and air leakage at the joint due to the high internal pressure.

Further, the outer surface of the air dissolving tank 1 is provided with reinforcing ribs 17 arranged horizontally and vertically in a staggered manner, which may increase the strength of the air dissolving tank 1 and avoid deformation and air leakage due to the high internal pressure.

In the embodiment of the present application, the cavitator 2 may adopt a structure of a known cavitation device in the prior art, e.g., an ultrasonic generator, or the like.

Figure 4:
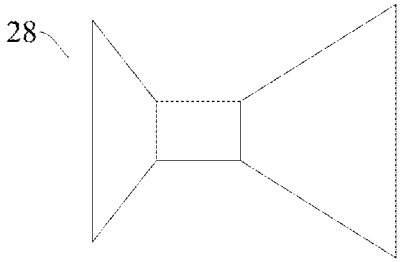
FIG. 4 is a schematic structural diagram of a Venturi tube according to an embodiment of the present application.

In some embodiments of the present disclosure, as shown in FIG. 4, the cavitator 2 includes a Venturi tube 28. Thus, it is possible to relatively easily precipitate the air dissolved in the water flow passing through the cavitator 2 and to produce bubbles. The Venturi tube 28 is taken as the cavitator 2, without additional water pump, heating device or control valve 4, or the like, which greatly simplifies the structure of the cavitator 2 and reduces the production cost. The Venturi tube 28 does not have additional requirements on the way of water intake, and the cavitator 2 may easily generate a large number of bubbles.

Figure 5:
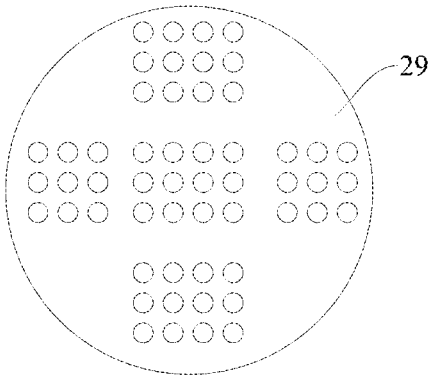
FIG. 5 is a schematic structural diagram of an orifice plate according to an embodiment of the present application.

In some other embodiments, as shown in FIG. 5, the cavitator 2 is configured as an orifice plate 29 provided with micro holes. Thus, the air dissolved in the water flow passing through the cavitator 2 may be relatively easily precipitated to form bubbles. In one embodiment, each of the micro holes in the orifice plate 29 has a radius of 0.01 mm-10 mm. It has been proved through experiments that the orifice plate 29 with the above-mentioned parameters has better cavitation effects, and more bubbles may be generated. In one embodiment, the specific parameters of the orifice plate 29 may be adjusted by the staff according to the actual working conditions, and are not limited to the above-mentioned range.

Figure 6:
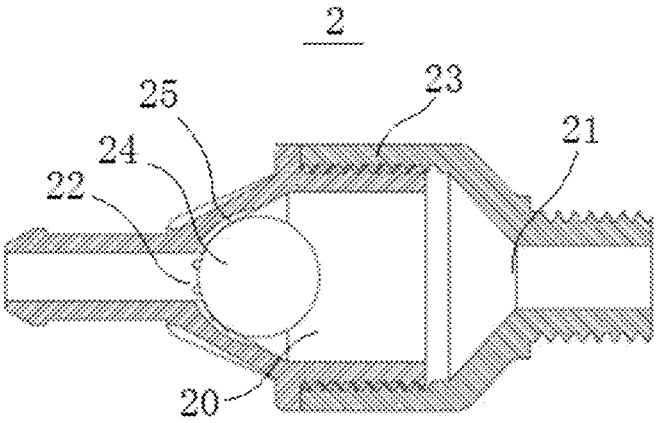
FIG. 6 is a schematic structural diagram of a cavitator according to an embodiment of the present application.

In some further embodiments, as shown in FIG. 6, the cavitator 2 includes a cavitation casing 23 and a cavitation ball 24. The cavitation casing 23 is provided therein with a water cavity 20, the water cavity 20 has a cavitation inlet 21 and a cavitation outlet 22 for water to flow in and out, and the cavitation inlet 21 is connected with the outlet 12 of the air dissolving tank 1. The cavitation ball 24 is movably disposed in the water cavity 20, the water flowing in from the cavitation inlet 21 may push the cavitation ball 24 to block the cavitation outlet 22, and when the cavitation ball 24 is blocked at the cavitation outlet 22, the Venturi channel 25 is formed between the cavitation ball 24 and the inner wall of the water cavity 200.

When the cavitation ball 24 is blocked at the cavitation outlet 22, the Venturi channel 25 in communication with the cavitation outlet 22 is provided between the cavitation ball 24 and the inner wall of the water cavity 22. It is shown herein that the cavitation ball 24 does not completely block the cavitation outlet 22, but leaves the Venturi channel 25, and the water flow with air dissolved in gradually flows out of the cavitation outlet 22.

By setting the movable cavitation ball 24 in the water cavity 20 in front of the cavitation outlet 22, when the water flow with air dissolved in is continuously introduced through the cavitation inlet 21, the continuously introduced water flows along the inner wall of the water cavity 20, and pushes the cavitation ball 24 to move toward the cavitation outlet 22 after encountering the cavitation ball 24, and the cavitation ball 24 moves to the front of the cavitation outlet 22 and gradually abuts against the cavitation outlet 22, forming the Venturi channel 25.

When the water with the air solute dissolved in flows through the Venturi channel 25, the open area will decrease and then increase. As the open area decreases and the flow velocity of the water with gas solute increases, the pressure decreases. As the open area increases and the flow velocity of the gas solute decreases, the pressure increases. The Venturi channel 25 corresponds to a Venturi tube and may produce the Venturi effect, and air is precipitated from the solute state to form microbubbles. Moreover, the water flow keeps the cavitation ball 24 against the cavitation outlet 22, and the water flow with the gas solute dissolved in flows out of the Venturi channel 25 more quickly.

In this process, the continuously introduced water flow is greater than the outgoing water flow, and the water cavity 20 is used as an air-tight cavity. When the cavitation ball 24 abuts against the cavitation outlet 22, the internal pressure will increase to strengthen the cavitation effect.

The adoption of such a cavitator 2 has not only low costs and low processing difficulty, but also advantages not available in other cavitation structures. The cavitation ball 24 is configured as a movable sphere. When the microbubble generator 100 stops working, the water flow decreases, and the cavitation ball 24 would leave the cavitation outlet 22 without the water flow, and the remaining water in the microbubble generator 100 may be drained quickly, which on the one hand, facilitates the air to be pre-stored in the air dissolving tank 1, and on the other hand, avoids breeding too much bacteria due to the water deposit. In addition, such a cavitator 2 is also easy to clean.

In some embodiments, the microbubble generator 100 further includes an air valve provided on the air dissolving tank 1. It should be noted that when dissolving gradually, the air in the air dissolving tank 1 decreases gradually. With the air valve provided on the air dissolving tank 1, when the air in the air dissolving tank 1 reduces, the air valve is open, and the external air would enter the air dissolving tank 1, and the air dissolving tank 1 is filled with sufficient air, which ensures that the microbubble generator 100 may increase air dissolving in the waterflow continuously.

The water treated by the microbubble generator 100 according to the embodiment of the present disclosure contains a large number of microbubbles, and such microbubble water is taken as washing water, which may reduce the usage amount of washing powder or detergent, save water and electricity resources, and reduce the residual washing powder or detergent on the laundry.

In a laundry treating device according to the embodiment of the present disclosure, a water inlet of the laundry treating device is provided with the microbubble generator 100 according to the above-mentioned embodiment of the present disclosure, and the microbubble generator 100 guides the produced microbubble water to a water tub of the laundry treating device.

With the above-mentioned microbubble generator 100, the laundry treating device according to the embodiment of the present disclosure has low costs and good microbubble generating effects. A large number of microbubbles in washing water reduces the usage amount of washing powder or detergent, saves water and electricity resources, and reduces the residual washing powder or detergent on the laundry.

Other components of the laundry treating device according to the embodiment of the present application, such as a motor, an impeller, a drum, or the like, and not described in detail herein.

In the description of the present application, it is to be understood that terms such as "center", "length", "upper", "lower", "vertical", "horizontal", "top", "bottom", "inner", and "outer" should be construed to refer to the orientation as then described or as shown in the drawings under discussion. These relative terms are for convenience of description and do not require that the present application be constructed or operated in a particular orientation, thus cannot be construed to limit the present application. In the description of the present disclosure, "a plurality of" means two or more unless otherwise stated.

In the present disclosure, unless specified or limited otherwise, the terms "mounted", "connected", "coupled" and "fixed" and the like are used broadly, and may be, for example, fixed connections, detachable connections, or integral connections; may also be mechanical or electrical connections; may also be direct connections or indirect connections via intervening structures; may also be inner communications or interactive relationship of two elements.

In the present disclosure, unless specified or limited otherwise, a structure in which a first feature is "on" or "below" a second feature may include an embodiment in which the first feature is in direct contact with the second feature, and may also include an embodiment in which the first feature and the second feature are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

In the description of the present specification, reference throughout this specification to "an embodiment", "some embodiments", "example", "specific example" or "some examples" means that a particular feature, structure, material, or characteristic described in connection with the embodiment or example is included in at least one embodiment or example of the present disclosure. In the specification, the schematic expressions to the above-mentioned terms are not necessarily referring to the same embodiment or example. Furthermore, the described particular features, structures, materials, or characteristics may be combined in any suitable manner in one or more embodiments or examples.

What is claimed is:

1. A microbubble generator, comprising:

an air dissolving tank, defining an air dissolving cavity therein, and having an inlet and an outlet configured to allow water to flow in and out, the inlet being provided at a top surface of the air dissolving tank, the outlet being provided at a bottom surface of the air dissolving tank;

a flat baffle plate, provided in the air dissolving tank and located between the inlet and the outlet in a horizontal direction, and provided with a gap and/or a through hole; and a cavitator, provided outside the air dissolving tank and connected with the outlet, or provided at the outlet;

wherein the inlet and the outlet are staggered in a horizontal direction;

wherein the inlet is positioned in left side of the baffle plate, and the outlet is positioned in right side of the baffle plate;

wherein the baffle plate is configured to partially block the water flowing from the left side towards the right side so as to form splash and facilitate microbubble generation;

wherein the gap and the through hole enable the water to flow through and block bubbles caused by the splash to flow through;

wherein the air dissolving cavity has a square section in the horizontal direction;

wherein in the horizontal direction, the inlet and the outlet are located at two farmost ends of the air dissolving cavity.

2. The microbubble generator according to claim 1, wherein a distance between the inlet and at least one side wall of the air dissolving cavity is less than 50 mm.

3. The microbubble generator according to claim 2, wherein the distance between the inlet and the at least one side wall of the air dissolving cavity ranges from 1 mm to 20 mm.

4. The microbubble generator according to claim 1, wherein the air dissolving tank is provided with two air dissolving semi-casings fastened with each other, the inlet is provided in one of the air dissolving semi-casings and the outlet is provided in another one of the air dissolving semi-casings.

5. The microbubble generator according to claim 4, wherein the two air dissolving semi-casings are in contact fit with each other at a joint by means of a step surface.

6. The microbubble generator according to claim 1, wherein an outer surface of the air dissolving tank is provided with reinforcing ribs arranged horizontally and vertically in a staggered manner.

7. The microbubble generator according to claim 1, wherein an upper portion of the air dissolving tank is provided with a water inlet pipe in communication with the top of the air dissolving cavity, a lower portion of the air dissolving tank is provided with a water outlet pipe in communication with the bottom of the air dissolving cavity, and the water inlet pipe and the water outlet pipe are disposed horizontally.

8. The microbubble generator according to claim 1, wherein the microbubble generator is configured for a flow velocity of outflow water is less than a flow velocity of inflow water when the air is dissolved.

9. The microbubble generator according to claim 1, wherein the cavitator comprises:

a cavitation casing, provided therein with a water cavity having a cavitation inlet and a cavitation outlet for water to flow in and out, the cavitation inlet being connected with the outlet of the air dissolving tank; and a cavitation ball, movably provided in the water cavity and configured to partially block the cavitation outlet to form a Venturi channel between the cavitation ball and an inner wall of the water cavity when the water flowing in from the cavitation inlet.

10. A laundry treating device, provided with the microbubble generator according to claim 1 at a water inlet of the laundry treating device.

* * * * *